US008506236B2

(12) United States Patent
Alison-Youel

(10) Patent No.: US 8,506,236 B2
(45) Date of Patent: Aug. 13, 2013

(54) COUNTER ROTATION INDUCER HOUSING

(75) Inventor: Sarah D. Alison-Youel, Reno, NV (US)

(73) Assignee: Ebara International Corporation, Sparks, NV (US)

( * ) Notice: Subject to any disclaimer, the term of this patent is extended or adjusted under 35 U.S.C. 154(b) by 828 days.

(21) Appl. No.: 12/701,453

(22) Filed: Feb. 5, 2010

(65) Prior Publication Data

US 2011/0027076 A1 Feb. 3, 2011

Related U.S. Application Data

(60) Provisional application No. 61/273,376, filed on Aug. 3, 2009.

(51) Int. Cl.
*F01D 5/00* (2006.01)
*F04D 1/04* (2006.01)

(52) U.S. Cl.
USPC ..... 415/72; 415/220; 415/183

(58) Field of Classification Search
USPC ..... 415/71–74, 76, 88, 126, 127, 143, 415/212.1, 220, 221, 83, 85, 167, 183, 184, 415/185, 186; 416/231 B, 235, 236 R, 242, 416/243
See application file for complete search history.

(56) References Cited

U.S. PATENT DOCUMENTS

| | | | | |
|---|---|---|---|---|
| 551,853 | A | 12/1895 | Desgoffe | |
| 1,490,955 | A | 4/1924 | Bell et al. | |
| 1,839,126 | A | 12/1931 | Sperry | |
| 2,397,139 | A | 3/1946 | Heaton | |
| 2,706,451 | A | 4/1955 | Mayer-Ortiz et al. | |
| 2,984,189 | A | 5/1961 | Jekat | |
| 3,198,423 | A | 8/1965 | Clute | |
| 3,420,184 | A | 1/1969 | Englesberg et al. | |
| 3,442,220 | A | 5/1969 | Mottram et al. | |
| 3,644,056 | A | 2/1972 | Wiselius | |
| 3,737,249 | A | 6/1973 | Cooper | |
| 3,975,117 | A | 8/1976 | Carter | |
| 4,019,829 | A | 4/1977 | Knopfel et al. | |
| 4,540,334 | A | 9/1985 | Stahle | |
| 4,648,796 | A | 3/1987 | Maghenzani | |
| 4,721,435 | A * | 1/1988 | Kuah | 415/143 |
| 4,789,299 | A | 12/1988 | Demetrius et al. | |
| 5,487,644 | A | 1/1996 | Ishigaki et al. | |
| 5,505,594 | A | 4/1996 | Sheehan | |
| 5,562,405 | A | 10/1996 | Ryall | |
| 6,116,338 | A | 9/2000 | Morrison et al. | |
| 6,220,816 | B1 | 4/2001 | Nguyen et al. | |
| 6,343,909 | B1 | 2/2002 | Springer et al. | |

(Continued)

OTHER PUBLICATIONS

B. Lakshminarayana, Fluid Dynamics of Inducers—A Review, Transactions of the ASME Journal of Fluids Engineering, Dec. 1982, vol. 104, pp. 411-427.

Okamura et al., An Improvement of Performance-Curve Instability in a Mixed-Flow Pump by J-Grooves, Proceedings of 2001 ASME Fluids Engineering Division, Summer Meeting (FEDSM'01), May 29-Jun. 1, 2001, New Orleans, Louisiana.

(Continued)

*Primary Examiner* — Edward Look
*Assistant Examiner* — William Grigos
(74) *Attorney, Agent, or Firm* — Woodcock Washburn LLP

(57) ABSTRACT

An inducer with an exterior housing and/or interior hub that incorporates grooves or vanes that are helical in nature and in counter rotation with respect to the rotation of the blades of the inducer, which grooves or vanes capture fluid rotating with the inducer blades and use that rotation to guide the fluid up along paths formed by the grooves or vanes and into an impeller, pump or other device.

22 Claims, 8 Drawing Sheets

(56) References Cited

U.S. PATENT DOCUMENTS

| | | | | |
|---|---|---|---|---|
| 6,361,271 | B1 * | 3/2002 | Bosley | 415/72 |
| 6,474,939 | B1 | 11/2002 | Bratu | |
| 6,547,514 | B2 * | 4/2003 | Lee | 415/1 |
| 7,021,890 | B2 | 4/2006 | Ishigaki et al. | |
| 7,207,767 | B2 | 4/2007 | Ashihara et al. | |
| 7,455,497 | B2 | 11/2008 | Lee | |
| 7,510,368 | B2 | 3/2009 | Stahle | |
| 7,862,302 | B2 | 1/2011 | Harman | |
| 2007/0248454 | A1 * | 10/2007 | Davis et al. | 415/74 |
| 2011/0123321 | A1 | 5/2011 | Kilkenny | |

OTHER PUBLICATIONS

Helicoid, http://en.wikipedia.org/wiki/Helicoid, Dec. 1, 2012.

Lavis et al, Advanced Compact Waterjet Propulsion for High-Speed Ships, 9$^{th}$ International Marine Design Conference, 2006; Ann Arbor, MI, May 16-19, 2006.

Purnell, John, Advanced Compact Waterjet Propulsion for High-Speed Ships, The Quarterly Digest of CDI Marine Systems Development Division (SDD), formerly Band, Lavis & Associates., 900 Ritchie Highway, Severna Park, MD 21146, Apr. 2005, vol. 29, 1-8 pages.

* cited by examiner

COUNTER ROTATION INDUCER HOUSING

CROSS-REFERENCES TO RELATED APPLICATIONS

This is a non-provisional, utility patent application, taking priority from provisional patent application Ser. No. 61/273,376, filed Aug. 3, 2009, which application is incorporated herein by reference.

BRIEF DESCRIPTION OF THE INVENTION

An embodiment is directed to inducers, and more particularly to a housing for an inducer that incorporates grooves or vanes that are helical in nature and in counter rotation with respect to the rotation of the blades of the inducer, which grooves or vanes capture fluid rotating with the inducer blades and use that rotation to move the fluid up along the grooves or vanes and into an impeller, pump or other device.

STATEMENT AS TO THE RIGHTS TO INVENTIONS MADE UNDER FEDERALLY SPONSORED RESEARCH OR DEVELOPMENT

Not Applicable.

REFERENCE TO A "SEQUENCE LISTING," A TABLE, OR A COMPUTER PROGRAM LISTING APPENDIX SUBMITTED ON A COMPACT DISK

Not Applicable.

BACKGROUND OF THE INVENTION

A common problem with spiral inducers used within centrifugal pumps and similar devices is that the fluid in the tank in which the centrifugal pump is installed will begin to rotate in the same direction as, and along with, the inducer blades. When this occurs, the fluid does not move up through the inducer as efficiently. This phenomenon can also result in a change in pressure near the inlet of the inducer and increase the amount of net positive suction head (NPSH) required to make the pump continue to work efficiently or properly.

Net positive suction head required (NPSHR) is a measure of the amount of head or pressure required to prevent the fluid from cavitating, i.e., the formation of vapor bubbles in a flowing fluid. It is desirable to prevent cavitation in devices like inducers, impellers and pumps because the fluid vapor bubbles created by cavitation can generate shock waves when they collapse that are strong enough to damage moving parts around them. While a higher NPSHR is desirable to prevent cavitation in an inducer, impeller and pump, a high NPSHR can also generate cavitation in the tank as the fluid level drops. Hence, a low NPSHR is desirable to enable more fluid to be pumped out of the tank or structure. Accordingly, other solutions are required to reduce cavitation at the inlet of an inducer while not increasing the NPSHR.

Inducers are frequently used in cryogenic systems, including storage tanks, rocket fuel pump feed systems, and other similar uses. Inducers are used in such systems to prevent the fluid being moved from cavitating in the impeller or pump, which can occur when there is not enough pressure to keep the liquid from vaporizing. Non-cavitating inducers are used to pressurize the flow of the fluid sufficient to enable the devices to which the inducer is attached to operate efficiently. An excellent discussion of the fluid dynamic properties of inducers is provided by B. Lakshminarayana, *Fluid Dynamics of Inducers—A Review*, Transactions of the ASME Journal of Fluids Engineering, December 1982, Vol. 104, Pages 411-427, which is incorporated herein by reference.

The techniques used to improve pump performance relative to the operation of inducers vary significantly. For example, Nguyen Duc et al., U.S. Pat. No. 6,220,816, issued Apr. 24, 2001, describes a device for transferring fluid between two different stages of a centrifugal pump through use of a stator assembly that slows down fluid leaving one impeller before entering a second impeller. A different technique is used in Morrison et al., U.S. Pat. No. 6,116,338, issued Sep. 12, 2000, which discloses a design for an inducer that is used to push highly viscous fluids into a centrifugal pump. In Morrison et al., an attempt is made to resolve the problem of fluids rotating with the inducer blades by creating a very tight clearance between the blades of the auger of the inducer and the inducer housing, and configuring the auger blades in such a way as to increase pressure as fluid moves through the device to the pump.

While grooves have been used in inducer designs in the past, they have not been used to help efficiently move the fluid through the inducer. For example, in Knopfel et al., U.S. Pat. No. 4,019,829, issued Apr. 26, 1977, an inducer is illustrated that has a circumferential groove around a hub at the front of the inducer. This design causes turbulence to develop within the grooves of the inducer hub rather than in the fluid outside of the grooves, thereby reducing the tendency of the fluid to pulsate and generate noise.

Grooves are also illustrated and described in Okamura et al., *An Improvement of Performance-Curve Instability in a Mixed-Flow Pump by J-Groves*, Proceedings of 2001 ASME Fluids Engineering Division, Summer meeting (FEDSM '01), May 29-Jun. 1, 2001, New Orleans, La. In Okamura et al., a series of annular grooves are formed on the inner casing wall of a mixed-flow water pump to suppress inlet flow swirl and therefore passively control the stability performance of the pump. In particular, the J-grooves of Okamura et al. reduce the onset of back flow vortex cavitation and rotating cavitation that can be induced by the flow swirl at the inlet of the inducer.

Okamura et al. acknowledge, however, that increasing the specific speed of mixed-flow pumps has a tendency to make their performance curves unstable and to cause a big hump at low capacities, thus it is stated that it is doubtful that the illustrated technique would be effective for higher specific-speed (i.e., higher flow rate) pumps.

DETAILED DESCRIPTION OF THE INVENTION

An embodiment is directed to inducers, and more particularly to a housing for an inducer that incorporates grooves or vanes that are helical in nature and in counter rotation with respect to the rotation of the blades of the inducer, which grooves or vanes capture fluid rotating with the inducer blades and use that rotation to move the fluid up along the grooves or vanes and into an impeller, pump or other device.

Figure 1:
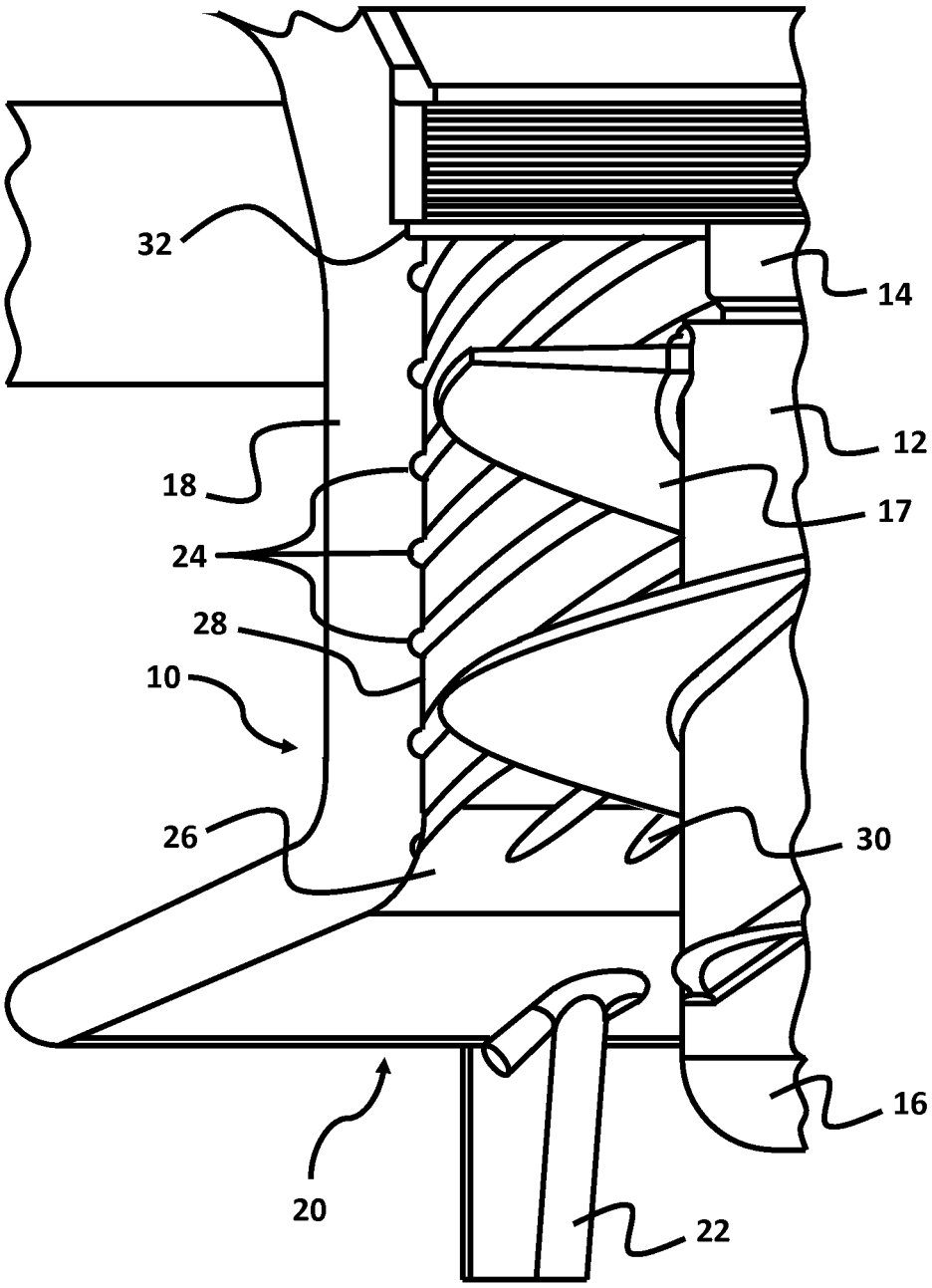
FIG. 1 is a partially broken, cross-sectional, perspective view of an inducer auger and an outer housing of an inducer including a series of grooves in accordance with an embodiment.

FIG. 1 is an embodiment of an inducer assembly 10, including an auger 12 mounted on a shaft 14, with a hub 16 and blades or vanes 17, rotating within an outer inducer housing 18. The substantially bell-shaped inlet 20 to the inducer 10 is raised off of the bottom surface of a tank or other structure (not shown) by the feet 22 so fluid (not shown) in the tank or structure can enter and be funneled toward the inducer 10 and be moved up into another device mounted above the inducer 10, such as an impeller or a pump. The blades 17 of auger 12 of FIG. 1 are helical structures that spiral in a first direction, in this case around the axis of the shaft 14 of the auger 12.

A series of helical grooves 24 are machined or formed into the circular interior wall 28 of the outer housing 18, either after the inlet (such that they start at the interior wall 28) or starting at a transition area 26 between the inlet 20 and the interior wall 28. The grooves 24, for example, can start out in the transition area 26 with a tapered section 30 and then form one or more semi-circular grooves 24 within the interior wall 28. As noted, the grooves 24 have a substantially helical shape that spirals in a second direction that is counter rotation to the first direction of the blades 17 of the auger 12. The grooves 24 can vary in depth and width, and the number of grooves 24 is dependent upon the fluid in the tank or structure and the process conditions.

Accordingly, as noted above, the number of grooves 24 can range from one groove 24 to as many grooves 24 as are necessary to maintain a lower NPSHR in the tank or structure. In particular, the one or more grooves 24 move fluid that is not being propagated up through the inducer 10 by the blades 17 because the fluid is rotating with the blades 17. More efficiently moving the fluid up through the inducer increases the NPSH (head) so, for example, a pump attached to the inducer 10 can pump the fluid to a lower level within the tank or structure and thus increase the capability and efficiency of the pump. The lowest fluid level a tank or structure can be pumped to is related to the point at which cavitation can occur because there is not enough NPSHA to prevent a vacuum. However, stopping cavitation from occurring is not a purpose of the grooves 24, since it will occur in any tank when the level of the fluid is pumped to the point where NPSHA cannot prevent a vacuum. Hence, a purpose of the present invention is to increase the efficiency of the pump so that the fluid in the tank or structure can be pumped to a lower level.

The grooves 24 can extend all of the way into the outlet 32 of the inducer 10. The counter rotation of the grooves 24 captures at least a portion of the fluid that is rotating with the blades 17 by pushing it into the grooves 24 and then uses that counter rotation to move the fluid up a path formed by the grooves 24 to the outlet 32 and into the structure above the inducer 10, such as an impeller. Since the helical pattern of the grooves 24 is counter to the helical pattern of the blades 17, the portion of the fluid pushed into the grooves 24 readily follows the path formed by the grooves 24 up the sides of the wall 28. If the grooves 24 had a helical pattern that was not counter to blades 17, the blades would be constantly cutting across the path of the grooves 24 and the fluid would not be able to follow the path. The blades 17 need to be positioned sufficiently so that fluid cannot readily escape between the wall 28 and the blades 17.

Although the grooves 24 and blades 17 are shown following an even spiral pattern, other patterns could also be used, as long as the pattern for the blades 17 matches the reverse pattern for the grooves 24. Hence, if the pattern of the blades became tighter as it progressed toward the outlet 32, the pattern for the grooves 24 would also have to become tighter, by an equal degree, as the grooves 24 moved up the interior wall 28, so as to prevent the blades 17 from cutting across the grooves 24 instead of allowing fluid around the blades 17 to follow the path of the grooves 24.

Figure 2:
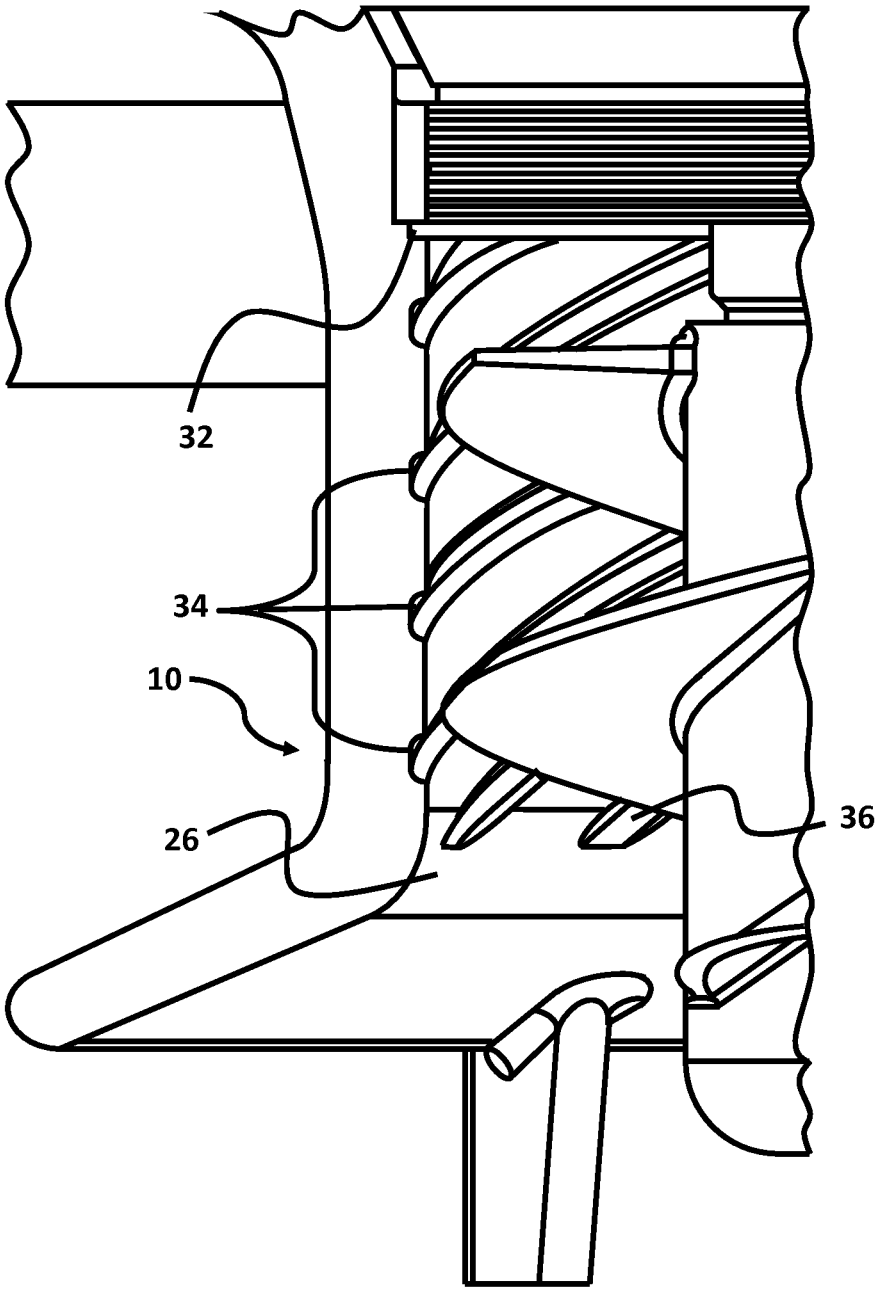
FIG. 2 is a partially broken, cross-sectional, perspective view of an inducer auger and an outer housing of an inducer including a different series of grooves in accordance with an embodiment.

FIG. 2 illustrates another embodiment of the inducer assembly 10 of FIG. 1, but with differently shaped grooves 34. The grooves 34 are more trough-shaped than the grooves 24, with a wider, flatter base area at the bottom of each groove 34. The grooves 34 extend all of the way to or into the outlet 32 and also extend into the transition area 26, where they have tapered sections 36.

Figure 3:
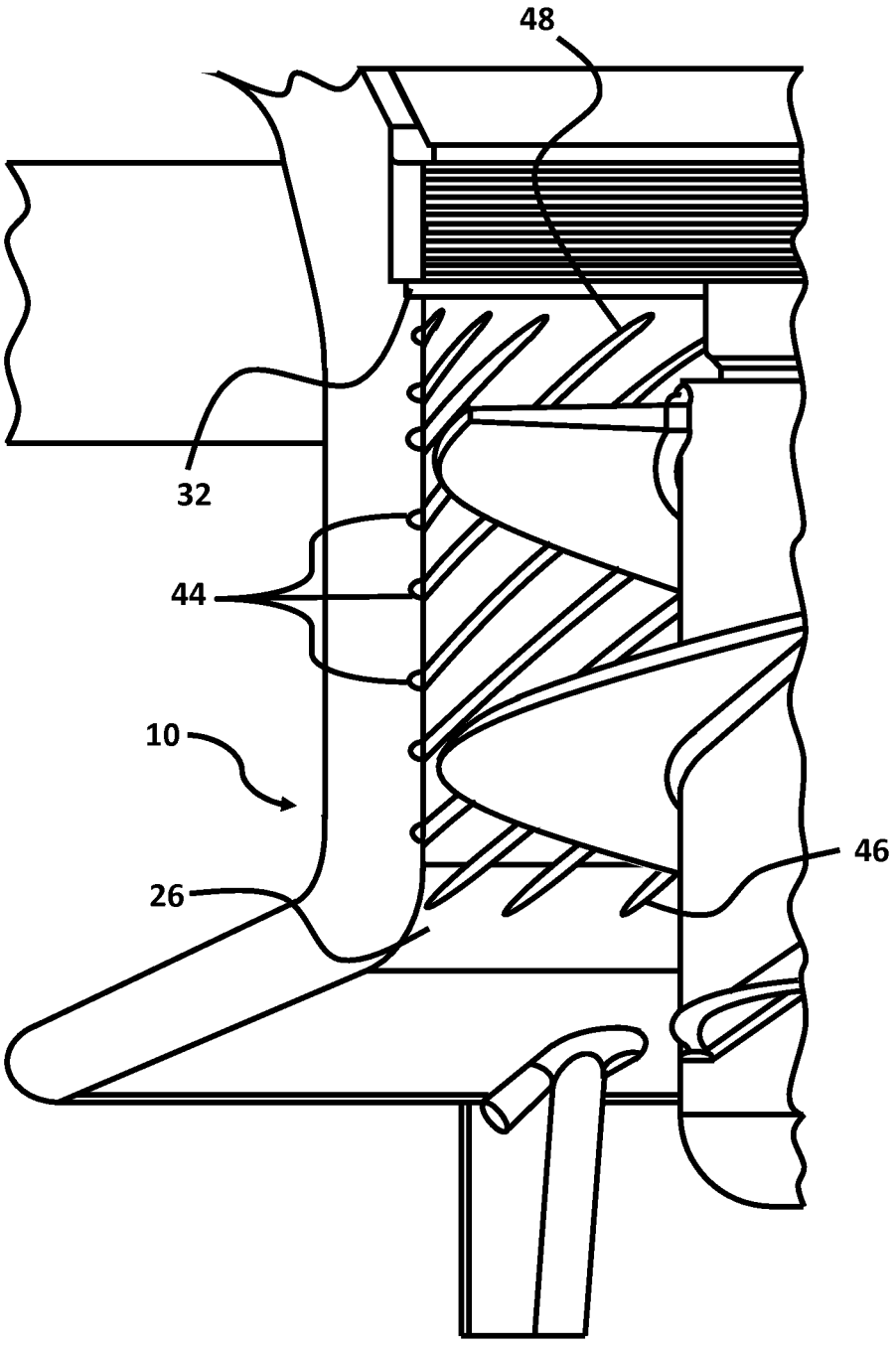
FIG. 3 is a partially broken, cross-sectional, perspective view of an inducer auger and an outer housing of an inducer including a different series of imbedded grooves in accordance with an embodiment.
Figure 4:
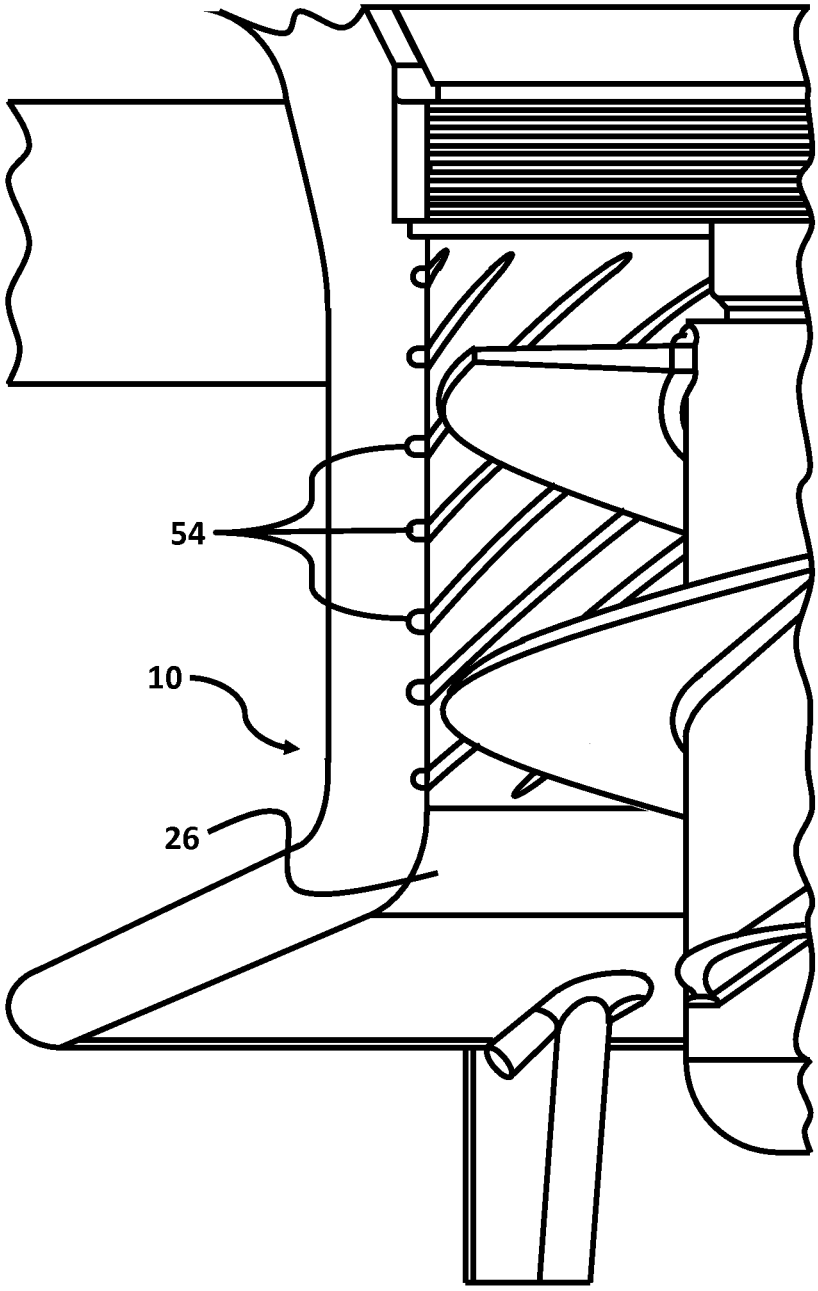
FIG. 4 is a partially, broken, cross-sectional, perspective view of an inducer auger and an outer housing of an inducer including a different series of imbedded groves in accordance with an embodiment.

FIG. 3 illustrates another embodiment of the inducer assembly 10 of FIG. 1, again with differently shaped grooves 44, which are slightly deeper than the grooves 24 of FIG. 1, but still rounded in the base area at the bottom of each groove 44, like grooves 24. Like the grooves 24 of FIG. 1 and grooves 34 of FIG. 2, the grooves 44 extend into the transition area 26 and have inlet tapered sections 46. Unlike the grooves 24 of FIG. 1, the grooves 44 do not extend all of the way to or into the outlet 32 and have outlet tapered sections 48, which are approximately 45 to 90 degrees from the outlet 32. The tapered sections 48 of grooves 44 could also be applied to the grooves 34 of FIG. 2, stopping approximately 45 to 90 degrees from the outlet 32. The inducer 10 of FIG. 4 is substantially similar to the inducer assembly 10 of FIG. 3, except the grooves 54 to not extend into the transition area 26.

Figure 5:
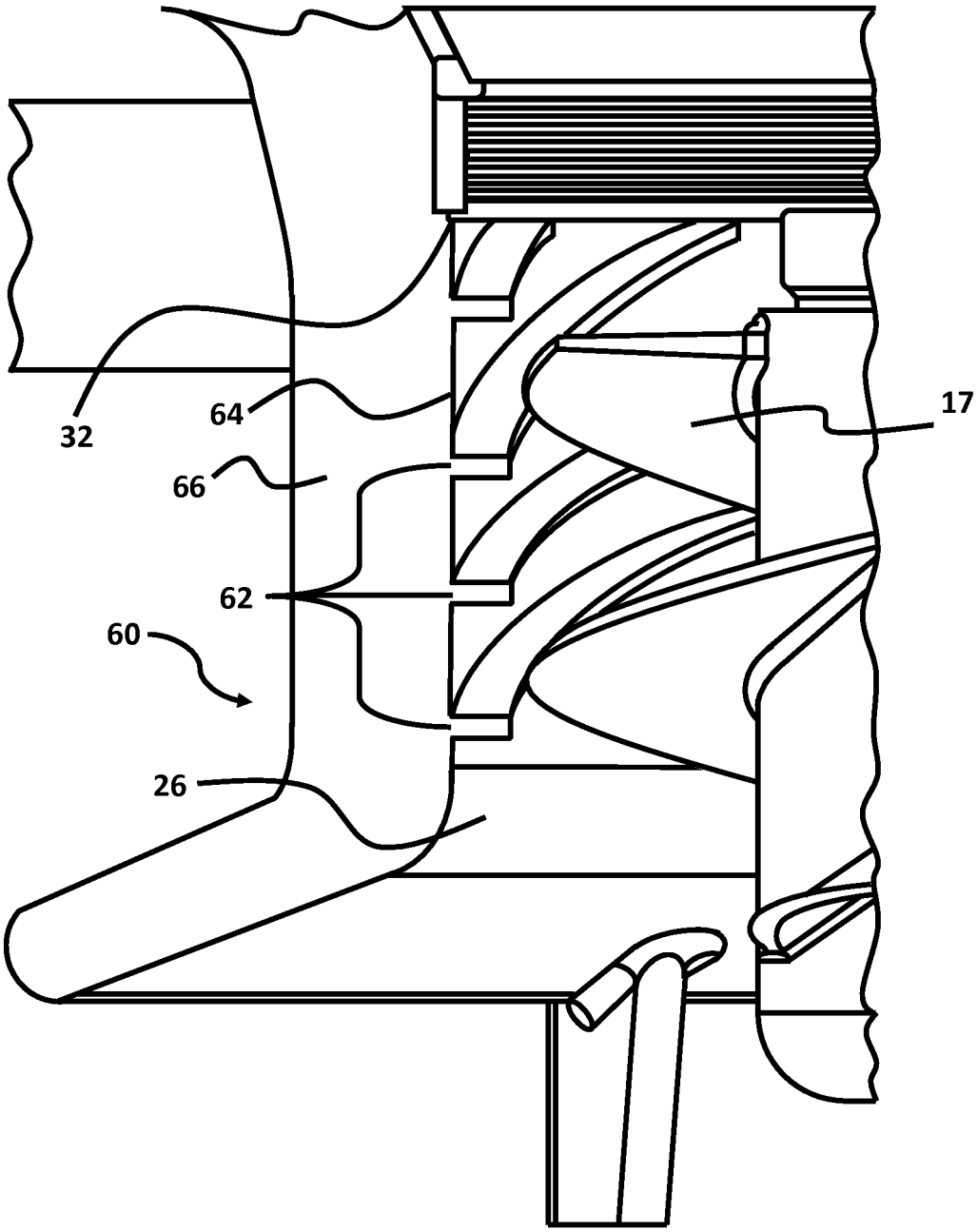
FIG. 5 is a partially broken, cross-sectional, perspective view of an inducer auger and an outer housing of an inducer including a series of vanes in accordance with an embodiment.

The inducer 60 of FIG. 5 is also similar to the inducer assembly 10, but has one or more vanes 62 formed in the interior wall 64 of the exterior housing 66 in place of the grooves. Like the grooves discussed above, the vanes 62 are helical structures that spiral in the second direction, which is counter rotation to the first direction of the blades 17, with the blades 17 and the vanes 62 having matching, but reverse, patterns. The vanes 62 do not extend into the transition area 26, but do extend all of the way or substantially all of the way to the outlet 32. The vanes 62, like the grooves of FIGS. 1-4, capture and guide fluid that is rotating with the blades 17, by pushing the fluid into the gaps formed between the vanes 62, and move the fluid to the outlet 32. The depth and width of the vanes 62 need to be sufficient to be durable and need to form a substantially tight relationship with the blades 17 so that fluid cannot readily escape between the vanes 62 and the blades 17. The height and width of the vanes 62 will depend on the fluid being moved and the particular application of the inducer 60.

Figure 6A:
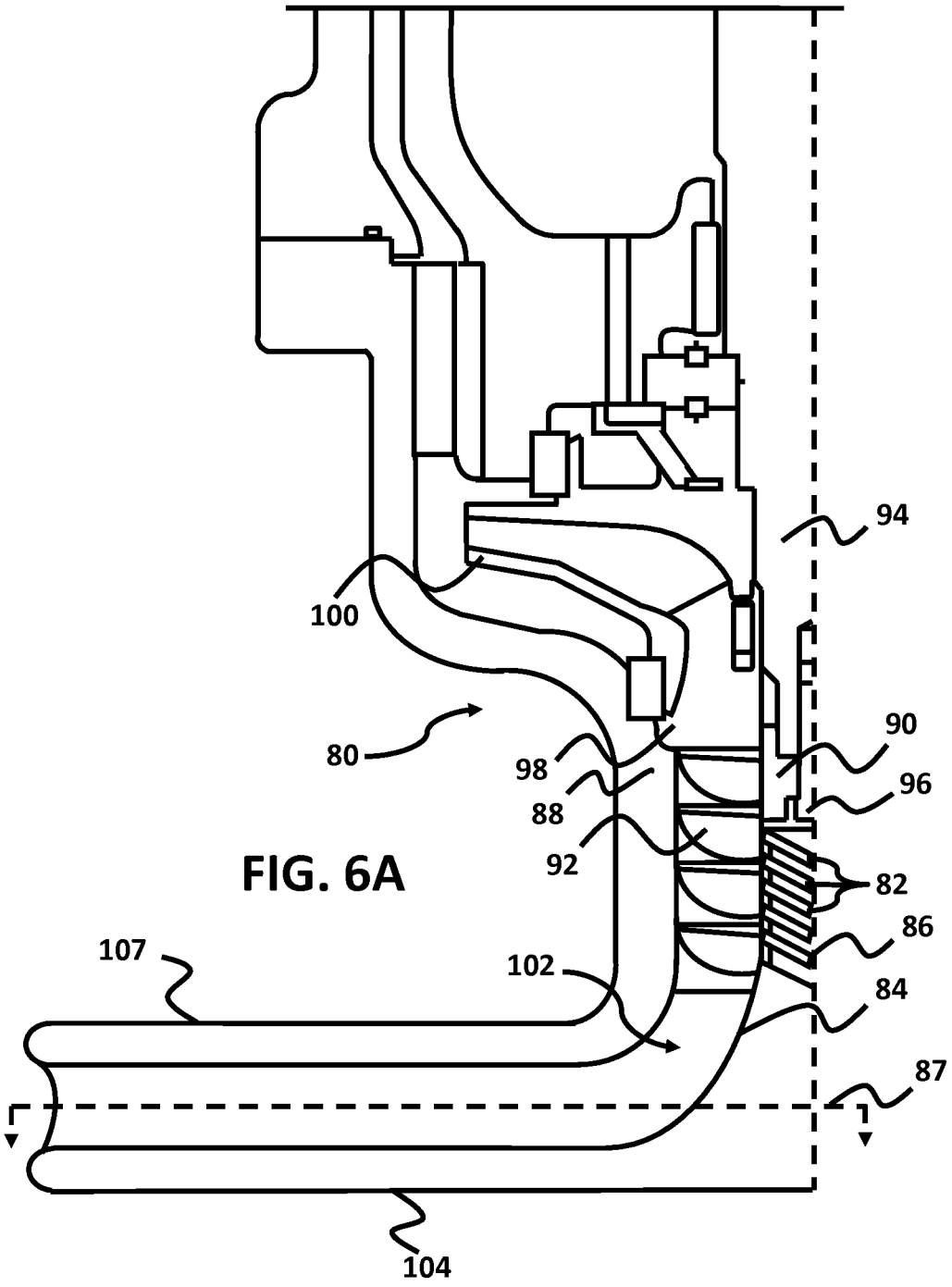
FIG. 6*a* is a partially broken, cross-sectional, side view of an impeller, inducer auger and an interior hub of an inducer including a series of imbedded groves in accordance with an embodiment.

FIG. 6*a* illustrates an embodiment of the inducer assembly 80 where the grooves 82 are formed within an interior wall 84 of an interior hub 86, instead of in the exterior housing 88. The grooves 82 are helical shapes that spiral in the second direction, which is counter rotation to the first direction. The auger 90 has blades 92 which are positioned sufficiently close to the interior wall 84 to push at least a portion of the fluid into the grooves 82 and guide fluid rotating with the blades 92 along a second path formed by the grooves 82. The grooves can have any of the shapes described above, or other shapes as may be appropriate.

FIG. 6*a* also illustrates how the auger 90, with blades 92, is mounted to the shaft 94 with a mounting assembly 96, such as a shaft bolt, a weld, a clamp, a cap or other suitable fastening mechanism that will mount the auger 90 to the shaft 94. The auger 12 would be mounted to the shaft 14 of FIG. 1, for example, in a similar manner, wherein a mounting assembly is not shown, since it is covered by hub 16. Unlike, the auger 12, however, the blades 92 of auger 90 overhang the mounting assembly and extend beyond the mounting assembly 96 and shaft 94. The interior hub 86 is stationary and sits on the bottom of the tank or structure, as further described below.

Figure 6B:
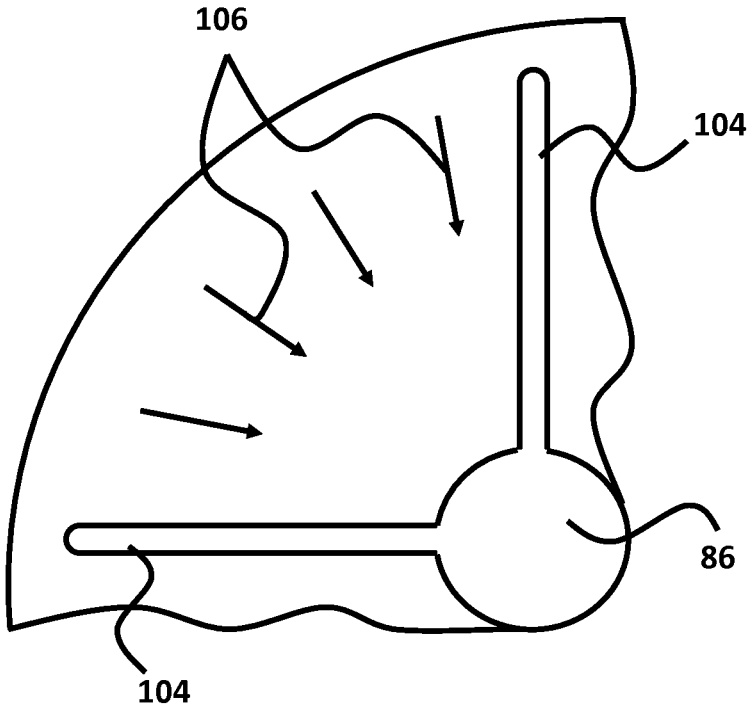
FIG. 6*b* is a partially broken, plan view of inlet vanes for the impeller of FIG. 6*a*.

In FIG. 6*a*, the outlet 98 is shown meeting an impeller 100 mounted above the inducer 80. At the other end of the inducer 80 is the inlet 102. Fluid is channeled into the inlet 102 by a series of inlet straightening vanes, having a lower vane 104 and an upper vane 107 formed from the interior hub 86 and the exterior housing 88, respectively. The inlet vanes stabilize the inducer assembly 80 on the bottom of the tank or structure and help to channel fluid into the inlet 102 of the inducer 80. FIG. 6*b* provides a partially broken, plan view of inlet straightening vanes 102 of FIG. 6*a*, from the direction of the dashed line 87 in FIG. 6*a*, to illustrate that fluid flows in the direction of the arrows 106 from the bottom of the tank or structure and into the inducer 80.

Figure 7:
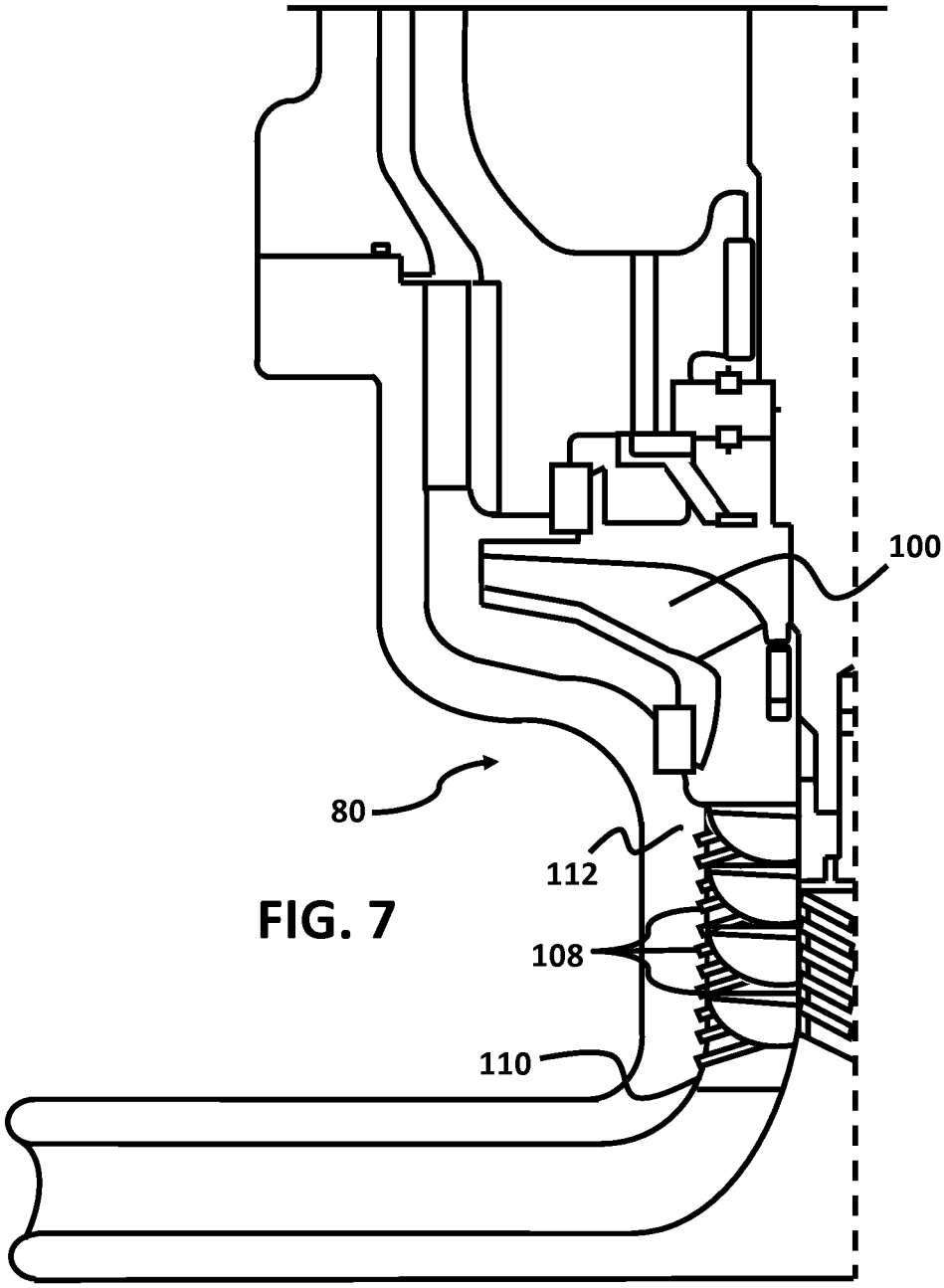
FIG. 7 is a partially broken, cross-sectional, side view of an impeller, inducer auger and an interior hub and an outer housing of an inducer including a series of imbedded groves in accordance with an embodiment.

FIG. 7 illustrates an embodiment of the inducer assembly 80 of FIG. 6*a*, where one or more grooves 108 are added to the interior wall 110 of the exterior housing 112, to further capture and guide fluid through the inducer 80 into the impeller 100. Many additional combinations of and variations to the grooves and vanes of the inducers illustrated above are possible and are contemplated by this disclosure. For example, referring back to FIG. 6*a*, vanes could be used on the interior wall 84 of an interior hub 86 instead of grooves.

Hence, while a number of embodiments have been illustrated and described herein, along with several alternatives and combinations of various elements, for use in an inducer to a pump or impeller, it is to be understood that the embodiments described herein are not limited to inducers only used with pumps and impellers and can have a multitude of additional uses and applications. Accordingly, the embodiments should not be limited to just the particular descriptions, variations and drawing figures contained in this specification, which merely illustrate a preferred embodiment and several alternative embodiments.

What is claimed is:

1. An inducer assembly, comprising:

an auger mounted to a shaft and having one or more helical blades that spiral in a first direction about an axis of said shaft;

a housing surrounding said auger, said housing including an inlet, an outlet and an exterior housing having an interior wall with one or more helical grooves formed therein that spiral in a second direction that is in counter rotation to said first direction, said one or more helical blades being positioned sufficiently close enough to said interior wall to push at least a portion of a fluid rotating in said first direction with said one or more helical blades into said one or more helical grooves and to move said portion of said fluid toward said outlet along a path formed by said one or more helical grooves; and an interior hub positioned below said shaft on said axis, said interior hub having an interior hub wall with one or more interior helical grooves formed therein that spiral in the second direction in counter rotation to the first direction, wherein at least a portion of said one or more helical blades overhang said shaft and are positioned sufficiently close enough to the interior hub wall to push at least a second portion of said fluid into said one or more interior helical grooves and toward the shaft along a second path formed by said one or more interior helical grooves.

2. The inducer assembly as recited in claim 1, wherein said housing further includes a transition area between said inlet and said interior wall of said exterior housing, and wherein said one or more helical grooves extend into said transition area.

3. The inducer assembly as recited in claim 2, wherein said one or more helical grooves include a tapered section and wherein said tapered section begins within said transition area.

4. The inducer assembly as recited in claim 1, wherein said one or more helical grooves extend to said outlet.

5. The inducer assembly as recited in claim 1, wherein said one or more helical grooves include a tapered section and wherein said tapered section stops prior to said outlet.

6. The inducer assembly as recited in claim 5, wherein each of said one or more helical grooves spiral at an angle that extends at least 360 degrees around said interior wall, wherein said tapered section is near an end of said one or more helical grooves, and wherein said tapered section stops within 45 to 90 degrees of said outlet as measured by said angle.

7. The inducer assembly as recited in claim 1, wherein said one or more helical grooves have a substantially semi-circular shape.

8. The inducer assembly as recited in claim 7, wherein said substantially semi-circular shape forms a bottom of a base area.

9. The inducer assembly as recited in claim 1, wherein said one or more helical grooves have a substantially trough shape.

10. The inducer assembly as recited in claim 9, wherein said substantially trough shape forms a substantially flat bottom of a base area.

11. The inducer assembly as recited in claim 1, wherein said one or more helical grooves includes a tapered section that begins after the inlet.

12. The inducer assembly as recited in claim 1, wherein said exterior housing and said interior hub include one or more inlet vanes for supporting the inducer and channeling said fluid into said inlet.

13. An inducer assembly, comprising:

an auger mounted to a shaft by a mounting assembly and having one or more helical blades that spiral in a first direction about an axis of said shaft;

a housing surrounding said auger, said housing including an inlet, an outlet and an exterior housing having an interior wall with one or more helical grooves formed therein that spiral in a second direction that is in counter rotation to said first direction, said one or more helical blades being positioned sufficiently close enough to said interior wall to push at least a portion of a fluid rotating in said first direction with said one or more helical blades into said one or more helical grooves and to move said portion of said fluid toward said outlet along a path formed by said one or more helical grooves; and an interior hub positioned below said shaft on said axis, said interior hub having an interior hub wall with one or more interior helical vanes formed thereon that spiral in the second direction in counter rotation to the first direction, wherein at least a portion of said one or more helical blades overhang the mounting assembly and are positioned sufficiently close enough to the interior hub wall to push at least a second portion of said fluid into one or more interior area formed between the one or more interior helical vanes and toward the shaft along a second path formed by said one or more interior helical vanes.

14. An inducer assembly, comprising:

an auger mounted to a shaft by a mounting assembly and having one or more helical blades that spiral in a first direction about an axis of said shaft;

a housing surrounding said auger, said housing including an inlet, an outlet and an exterior housing having an interior wall with one or more helical vanes formed thereon that spiral in a second direction that is in counter rotation to said first direction, said one or more helical blades being positioned sufficiently close enough to said interior wall to push at least a portion of a fluid rotating in said first direction with said one or more helical blades into an area formed by said one or more helical vanes and to move said portion of said fluid toward said outlet along a path formed by said one or more helical vanes; and an interior hub positioned below said shaft on said axis, said interior hub having an interior hub wall with one or more interior helical grooves formed therein that spiral in the second direction in counter rotation to the first direction, wherein at least a portion of said one or more helical blades overhang the mounting assembly and are positioned sufficiently close enough to the interior hub wall to push at least a second portion of said fluid into one or more interior helical grooves and toward the shaft along a second path formed by said one or more interior helical grooves.

15. The inducer assembly as recited in claim 14, wherein said housing further includes a transition area between said inlet and said interior wall of said exterior housing, and wherein said one or more helical vanes extend into said transition area.

16. The inducer assembly as recited in claim 15, wherein said one or more helical vanes include a tapered section and wherein said tapered section begins within said transition area.

17. The inducer assembly as recited in claim 14, wherein said one or more helical vanes extend to said outlet.

18. The inducer assembly as recited in claim 14, wherein said one or more helical vanes include a tapered section and wherein said tapered section stops prior to said outlet.

19. The inducer assembly as recited in claim 18, wherein each of said one or more helical vanes spiral at an angle that extends at least 360 degrees around said interior wall, wherein said tapered section is near an end of said one or more helical vanes, and wherein said tapered section stops within 45 to 90 degrees of said outlet as measured by said angle.

20. The inducer assembly as recited in claim 14, wherein said one or more helical vanes includes a tapered section that begins after the inlet.

21. The inducer assembly as recited in claim 14, wherein said exterior housing and said interior hub include one or more inlet vanes for supporting the inducer and channeling said fluid into said inlet.

22. An inducer assembly, comprising:

an auger mounted to a shaft by a mounting assembly and having one or more helical blades that spiral in a first direction about an axis of said shaft, wherein said auger rotates about said axis of said shaft;

a housing surrounding said auger, said housing including an inlet, an outlet and an exterior housing having an interior wall with one or more helical vanes formed thereon that spiral in a second direction that is in counter rotation to said first direction, said one or more helical blades being positioned sufficiently close enough to said interior wall to push at least a portion of a fluid rotating in said first direction with said one or more helical blades into an area formed by said one or more helical vanes and to move said portion of said fluid toward said outlet along a path formed by said one or more helical vanes; and wherein said housing includes an interior hub positioned below said shaft on said axis, said interior hub having an interior hub wall with one or more interior helical vanes formed thereon that spiral in the second direction in counter rotation to the first direction, wherein at least a portion of said one or more helical blades overhang the mounting assembly and are positioned sufficiently close enough to the interior hub wall to push at least a second portion of said fluid into one or more interior areas formed between the one or more interior helical vanes and toward the shaft along a second path formed by said one or more interior helical vanes.

* * * * *